US006491300B2

(12) United States Patent
Harris et al.

(10) Patent No.: US 6,491,300 B2
(45) Date of Patent: Dec. 10, 2002

(54) BOARD GAME

(76) Inventors: Anthony William Harris, Rusthall, a Stable Court, Shaw, Berkshire, RG14 2DT (GB); Roger Malcolm Bates, 2 Heardman Close, Thatcham, Berkshire, RG19 4FB (GB)

( * ) Notice: Subject to any disclaimer, the term of this patent is extended or adjusted under 35 U.S.C. 154(b) by 0 days.

(21) Appl. No.: 09/972,885

(22) Filed: Oct. 10, 2001

(65) Prior Publication Data

US 2002/0063386 A1 May 30, 2002

(30) Foreign Application Priority Data

Nov. 29, 2000 (GB) ..... 0029081

(51) Int. Cl.[7] ..... A63F 3/00
(52) U.S. Cl. ..... 273/272; 273/431
(58) Field of Search ..... 273/272, 157 R, 273/429, 430, 431, 432

(56) References Cited

U.S. PATENT DOCUMENTS 4,306,724 A * 12/1981 Brzezinski et al.
4,850,595 A * 7/1989 Sherman et al.
5,566,942 A * 10/1996 Elum
6,322,074 B1 * 11/2001 Forrest et al.

* cited by examiner

*Primary Examiner*—William M. Pierce
(74) *Attorney, Agent, or Firm*—Arent Fox Kintner Plotkin & Kahn

(57) ABSTRACT

Apparatus for playing a game and comprising: a board having a grid of squares marked thereon, a set of player tokens which are allocated to respective players for placing on said grid; a set of markers each having a letter marked thereon and being arranged such that each may be placed on a corresponding square of said grid; a set of game cards each having a multiplicity of squares marked thereon, whereby in use selected markers can be removed from the grid by players and placed on squares of the game cards to construct words or phrases; and a set of question cards each having marked thereon a question. Each player throws a die to determine how far he can move his token across the board. Providing that the player can correctly answer a question read to him from a selected question card, he can remove a letter from the square on which he landed and use it to construct a word or phrase on his game card.

1 Claim, 2 Drawing Sheets

FIG.1

| | | | | | | | | | | | | |
|---|---|---|---|---|---|---|---|---|---|---|---|---|
| 1 synonym | | 2 anagram | cryptic | | 3 synonym | 4 cryptic | | 5 anagram | | 6 antonym | | 7 synonym |
| | | | | 8 | | | | | | bonus | | |
| 9 anagram | | synonym | | antonym | | 10 antonym | | | bonus | | bonus | cryptic |
| | | | | | | bonus | | bonus | | | | |
| 11 cryptic | | 12 antonym | | 13 cryptic | | | bonus | | | bonus | | anagram |
| | | bonus | | | | bonus | | | | | | |
| 14 synonym | bonus | | | 15 anagram | bonus | | bonus | anagram | | | bonus | synonym |
| | | | | | | bonus | | | | bonus | | |
| 16 anagram | | bonus | | | bonus | | | 17 cryptic | | 18 antonym | | 19 cryptic |
| | | | | bonus | | bonus | | | | | | |
| 20 cryptic | bonus | | bonus | | | antonym | | 21 antonym | | 22 synonym | | anagram |
| | | bonus | | | | | | anagram | | | | |
| 23 synonym | | antonym | | anagram | | cryptic | synonym | | 24 cryptic | antonym | | synonym |

BOARD GAME

CROSS-REFERENCE TO RELATED ART

Not Applicable

BACKGROUND OF THE INVENTION

1. Field Of The Invention

The present invention relates to a family board game based upon the solving of crossword clues and the making of words from individual letters. It is intended to appeal particularly to crossword lovers, and to any who would like to become more experienced at solving crossword clues.

According to a first aspect of the present invention there is provided apparatus for playing a game and comprising:

a board having a grid of squares marked thereon;

a set of player tokens which in use are allocated to respective players for placing on said grid and for movement therearound;

a set of markers, each having a letter of the alphabet marked thereon and being arranged such that each may be placed on a corresponding square of said grid;

a set of game cards each having a multiplicity of squares marked thereon, whereby in use selected markers can be removed from the grid by players and placed on squares of the game cards to construct words or phrases; and a set of question cards each having marked thereon a question to be answered by a player. For a better understanding of the present invention and in order to show how the same may be carried into effect reference will now be made by way of example to the accompanying drawing.

2. Description of Related Art

The aim is to collect individual letters of the alphabet, and arrange these on a pre-formatted game card to make valid words. Letters are collected from certain squares on the game board, which takes the form a crossword grid. Players move around the board by throwing a die, attempting to land on a square containing a letter, which he may win by correctly solving a crossword clue. The winning player, or team, is the first to complete a game card with valid interlocking words, and then to solve a clue from a Category chosen by the other players.

BRIEF SUMMARY OF THE INVENTION

The game board is square in shape, and shows a crossword grid of 13×13 equal squares. Some squares show numbers, as on a conventional crossword puzzle, but these are decorative only, and have no meaning within the game. 62 of the squares each contains the name of a Category, of which there are five: SYNONYM, ANTONYM, CRYPTIC, ANAGRAM and BONUS.

BRIEF DESCRIPTION OF THE DRAWINGS

FIG. 1 shows a plan view of the Game Board, and

DETAILED DESCRIPTION OF THE INVENTION

Figure 2:
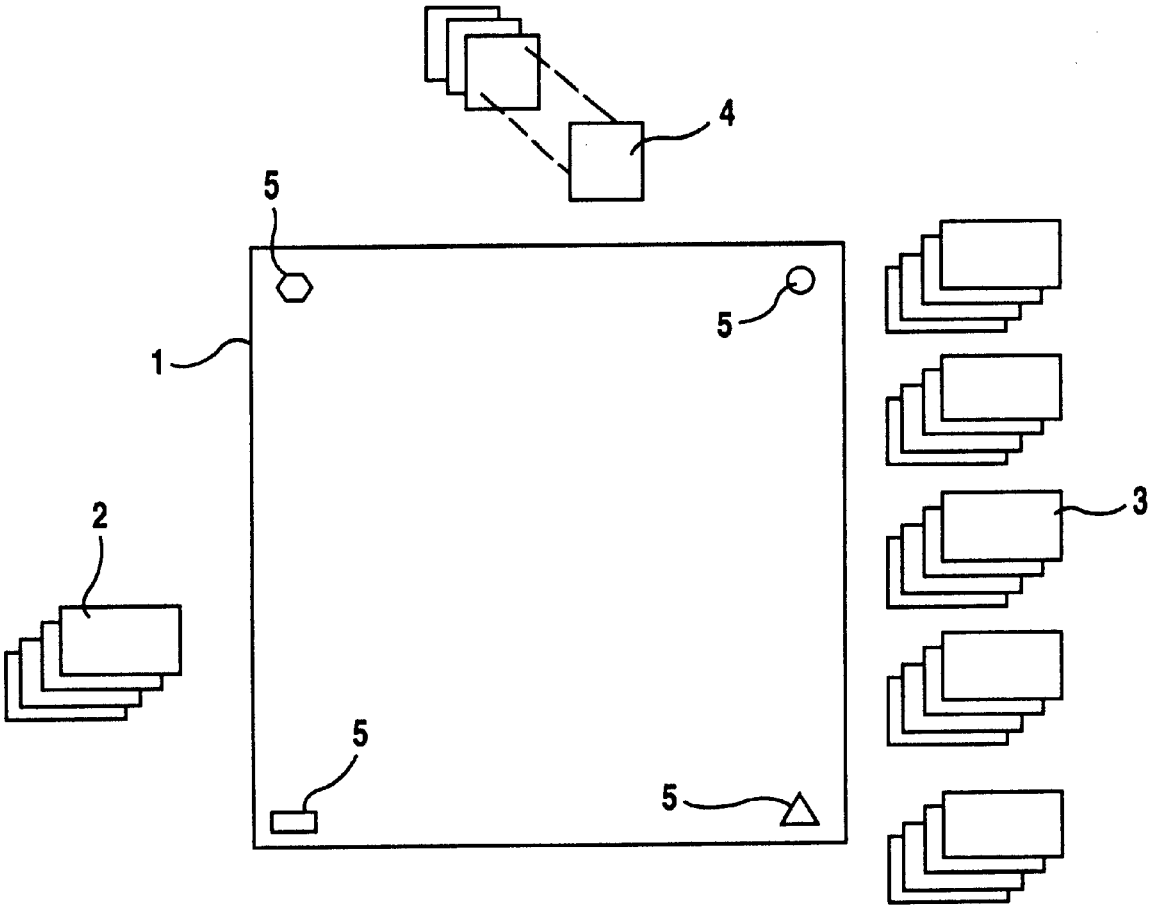
FIG. 2 shows a view of the board together with the game cards, category cards, letter cards and playing tokens.

Each player or team needs a Game Card 2, on which a mini crossword grid is shown. Some cards have 10 squares, others have 15. These squares are arranged such that letters from the Game Board 1 may be placed over them to form interlocking words. The back of each card shows just the number of squares contained in the grid.

There are five sets of Category Cards 3, corresponding to the five categories defined under "The Game Board" paragraph above. The Bonus Cards show just the word BONUS on one side, with the name of one of the other four categories shown on the reverse. Each of the other Category Cards is set out as follows: On one side is shown the name of the Category, together with a clue of the appropriate type for this category, and a number of boxes denoting the number of letters in the answer. On the reverse is shown an additional Hint to help the solver, together with the answer.

The game includes 62 small letter cards 4, each bearing one letter of the alphabet.

There are six Playing Tokens 5 which players use to move around the Game Board.

Each of the 62 Letter Cards 4 is placed randomly on one of the Category squares of the Game Board 1, such that every Category square contains one Letter.

Each of the five sets of Category Cards 3 is shuffled separately, and these are placed in five piles at the side of the Game Board 1.

Players decide whether to play individually or in teams. Each player or team selects one of the six Playing Tokens 5, and places it on one of the four corner squares of the Game Board 1. Any number of Tokens may occupy the same square.

Players decide whether to use Game Cards 2 of 10 or 15 letters, according to the length of the game desired, and then the appropriate set is shuffled and placed grid-side down. Each player or team selects one at random.

Players move their Tokens around the board in order to win enough Letter cards to fill a Game card with valid interlocking words. In his turn, a player throws the die and moves his Token either up, down, left or right. He need not use up the full count of the die, so may stop on any square he passes, but he may not change direction during his move. Diagonal moves are not allowed. If his move ends on a blank square, play proceeds to the left. If he ends on a Category square, he is shown a question for the appropriate Category. If he ends on a Bonus square, he may choose the Category for his question.

At the start of each turn, a player must move off from the square he is on, even if there is a Letter there which he failed to win on his previous turn. In a later turn, he may move back to this square if desired.

Letter cards are won by correctly answering questions from the Category cards. If a player ends his turn on a Category square, the player to his RIGHT takes the top card from the appropriate category pile, and shows it to him, taking care not to disclose the answer on the back. Players landing on a Bonus square may choose the Category for their question. Even if there is no Letter card on the Category square (because it has already been won), the player must correctly answer a question before proceeding. An egg timer is used to restrict the time taken to consider the clue. If the player solves the clue in the allotted time, he may take the Letter card from that square and keep it for use in his Game Card. If he needs help with the clue, the player may elect to be given a Hint, in which case the player to his RIGHT reads the Hint from the back of the card, and restarts the timer. If he solves the clue without the aid of the Hint, the player has another turn, up to a maximum of three consecutive turns. This applies whether or not he takes a Letter card in any turn.

If he elected to use a Hint, then he is not entitled to another turn. If the Letter card from that square has already been won, he does not win a Letter for this turn. Players must not hold more letters than the number of boxes on the Game card. If a player already holds the maximum and has just won another Letter, he may choose either to leave the new one in its place on the board, or to take it and replace it with one from his Game Card.

If there is still a Letter card on a contested square at the end of turn, because the player has been unable to solve the clue, the player to his LEFT is shown the card, and may win that Letter if he answers correctly. In this case, there is no extra turn, but since play passes to the left, it will now be the start of that player's regular turn.

If a player's turn ends on a square occupied by an opponent's Playing Token, he has the option of exchanging any one of the Letters on his own Game Card with any one Letter from the opponent's Card. The player may then complete his turn in the normal way, according to the type of square on which he has landed.

When a player has won the correct numbers of Letters and has arranged them on his Game Card to form valid interlocking words, he must make his way to the central square on the board, answering any Category questions along the way, and observing the normal rules of play. Once on the central square, the other players choose a Category, and the player is give a question from this Category, which he must answer (with the aid of a Hint, if requested) in order to win. If he fails to answer, his turn is ended, and in his next turn, he must leave the central square and re-enter it in a later move, in the normal way.

The four Categories of clue are

ANAGRAM The letters on the card must be re-arranged to form a word or words which answer the clue.
E.g. ASINNMO Clue: A dwelling Answer: MANSION SYNONYM A synonym is a word which means that same as another word. One or more letters of the answers are some shown on the card.
E.g. _E_L-_ Clue: Full Answer: REPLETE ANTONYM An antonym is a word which means the opposite of another word.
E.g. ___P_E_____ Clue: Full Answer: DEPLETED CRYPTIC The card shows a full cryptic, crossword-style clue.
E.g. ___M_____ Clue: Some men took away my souvenir Answer: MEMENTO

What is claimed:

1. Apparatus for playing a game and comprising:

a board having a grid of squares marked thereon;

a set of player tokens which in use are allocated to respective players for placing on said grid and for movement therearound;

a set of markers, each having a letter of the alphabet marked thereon and being arranged such that each may be placed on a corresponding square of said grid;

a set of game cards each having a multiplicity of squares marked thereon, whereby in use selected markers can be removed from the grid by players and placed on squares of the game cards to construct words or phrases; and a set of question cards each having marked thereon a question to be answered by a player.

* * * * *